United States Patent [19]

Brown

[11] Patent Number: 4,753,150

[45] Date of Patent: Jun. 28, 1988

[54] BRAIDING APPARATUS

[75] Inventor: Richard T. Brown, Manassas, Va.

[73] Assignee: Atlantic Research Corporation, Alexandria, Va.

[21] Appl. No.: 60,814

[22] Filed: Jun. 12, 1987

[51] Int. Cl.[4] ..... D04C 3/00

[52] U.S. Cl. ..... 87/33; 87/28; 87/34; 139/11

[58] Field of Search ..... 87/33, 34, 28–30; 139/11, 13 R, 16, 55.1

[56] References Cited

U.S. PATENT DOCUMENTS 3,426,804 2/1969 Bluck ..... 87/33 X 4,312,261 1/1982 Florentine ..... 87/33

*Primary Examiner*—John Petrakes

*Attorney, Agent, or Firm*—Frank P. Presta

[57] ABSTRACT

Apparatus for braiding an article from a plurality of fibers, comprising a plurality of ring members of substantially the same size which are disposed side-by-side in axially aligned relation and have means for supporting fiber carriers for axial movement relative thereto. The ring members are mounted for rotation about a common central axis relative to each other. A plurality of rows of fiber carriers are mounted on the ring members for axial movement relative to the ring members. Actuating means are provided to rotate the ring members and to move the rows of fiber carriers axially in a predetermined manner to intertwine the fibers.

6 Claims, 2 Drawing Sheets

BRAIDING APPARATUS

BACKGROUND OF THE INVENTION

The present invention relates to multi-ply braiding apparatus and, more particularly, to a circular braiding apparatus wherein a matrix of fiber carriers are arranged in a cylindrical configuration.

The process of braiding is distinguished from weaving in that all fibers are interchanged (moved) in a braiding cycle while in weaving only a single fiber (the fill) is moved through a fixed array of fibers (the warp). Multi-ply braiding is distinguished from conventional braiding in that more than two layers (plys) are formed by the process.

Any braiding process is characterized by the fact of all fiber carriers being in motion resulting in intertwined fibers. Multi-ply braiding machines use a matrix array of carriers capable of alternate row and column position shifts. Reversal of the direction of row and column motion during a complete shift cycle produces the intertwining of fibers. Production of complex shapes is possible by adjusting the length of travel (number of spaces shifted) of each row or column.

Multi-ply braiding concepts and machines are disclosed in the patents to Bluck U.S. Pat. No. 3,426,804 and Florentine U.S. Pat. No. 4,312,261. In the Bluck and Florentine patents, the teachings of which are incorporated herein by reference, each row and column consists of discrete eyelets or carrier blocks. In other machines presently in use, row motion is accomplished by shifting grooved track members containing fiber carriers. Column motion consists of shifting the discrete fiber carriers. In circular concepts, row motion is accomplished by shifting concentric rings or track members, as shown in FIG. 6 of the Florentine patent. Column (radial) motion again consists of shifting discrete carriers.

In circular braiding machines, it is difficult and expensive to produce concentric rings of necessarily different diameters which fit properly together. Also, it is necessary to keep an inventory of many rings of different sizes for the replacement of rings that may be damaged in use. In addition, the capacity of the machine as measured by the number of rings cannot be easily expanded. A flat circular braiding machine having a large number of concentric rings is burdensome in that it requires a large amount of space and it is difficult to shift the carriers radially through a large number of rings without jamming taking place.

Accordingly, a need has arisen for a new and improved braiding apparatus of the circular type having interchangeable rings of the same diameters. This need is filled by the cylindrical braiding apparatus of the present invention.

SUMMARY OF THE INVENTION

The braiding apparatus of the present invention comprises a plurality of ring members that are of substantially the same diameter and disposed side-by-side in axially aligned relation. In one embodiment, fiber carrier members are slidably movable in circumferentially spaced tracks or grooves on the ring members for axial movement relative thereto.

In the braiding process, fibers are intertwined by moving adjacent rows of fiber carriers in opposite axial directions and by rotating adjacent ring members in opposite directions in a predetermined manner. Examples of such movement for braiding patterns in both rectangular and circular apparatus are illustrated in FIG. 3 of the Bluck patent and in FIGS. 5 and 9 of the Florentine patent. The fiber being braided may be fed to the interior or the exterior of the ring members.

DESCRIPTION OF THE PREFERRED EMBODIMENTS

Figure 1:
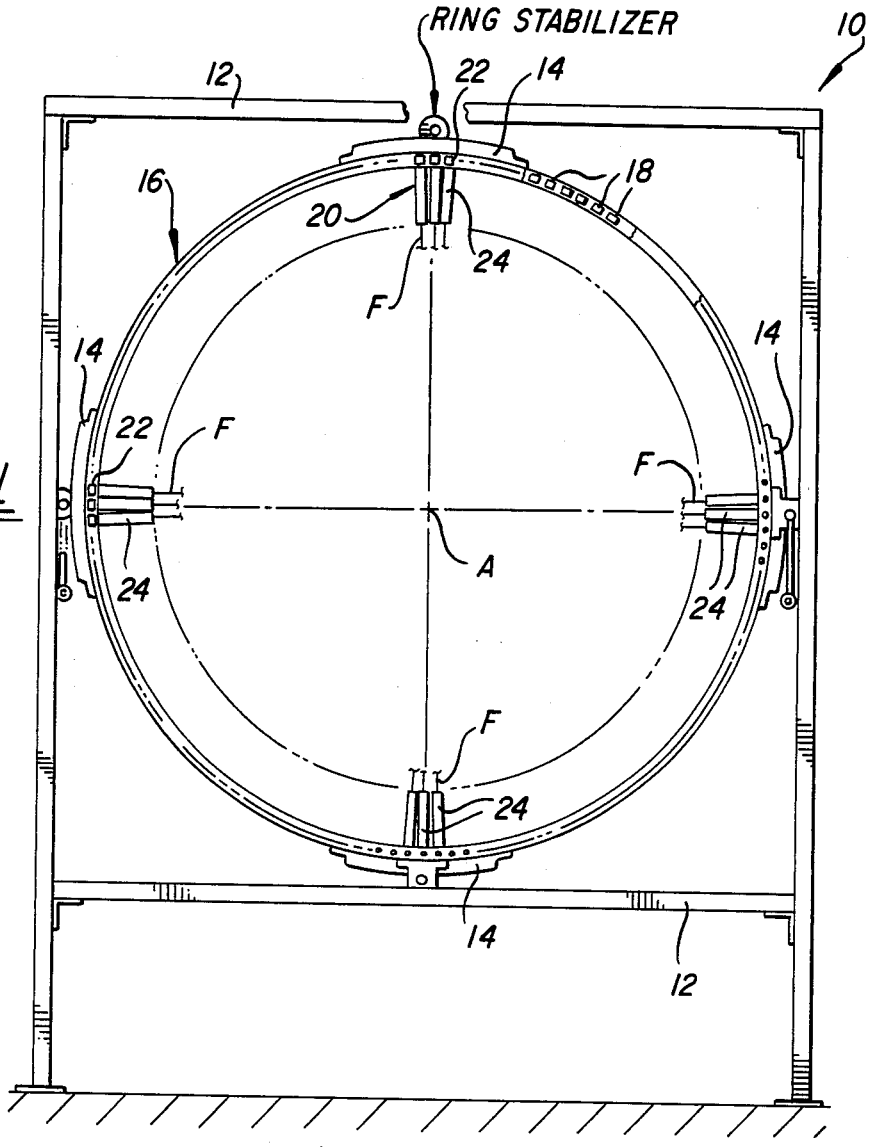
FIG. 1 is a front elevational view, with parts broken away, of a braiding apparatus constructed in accordance with the principles of the present invention.
Figure 2:
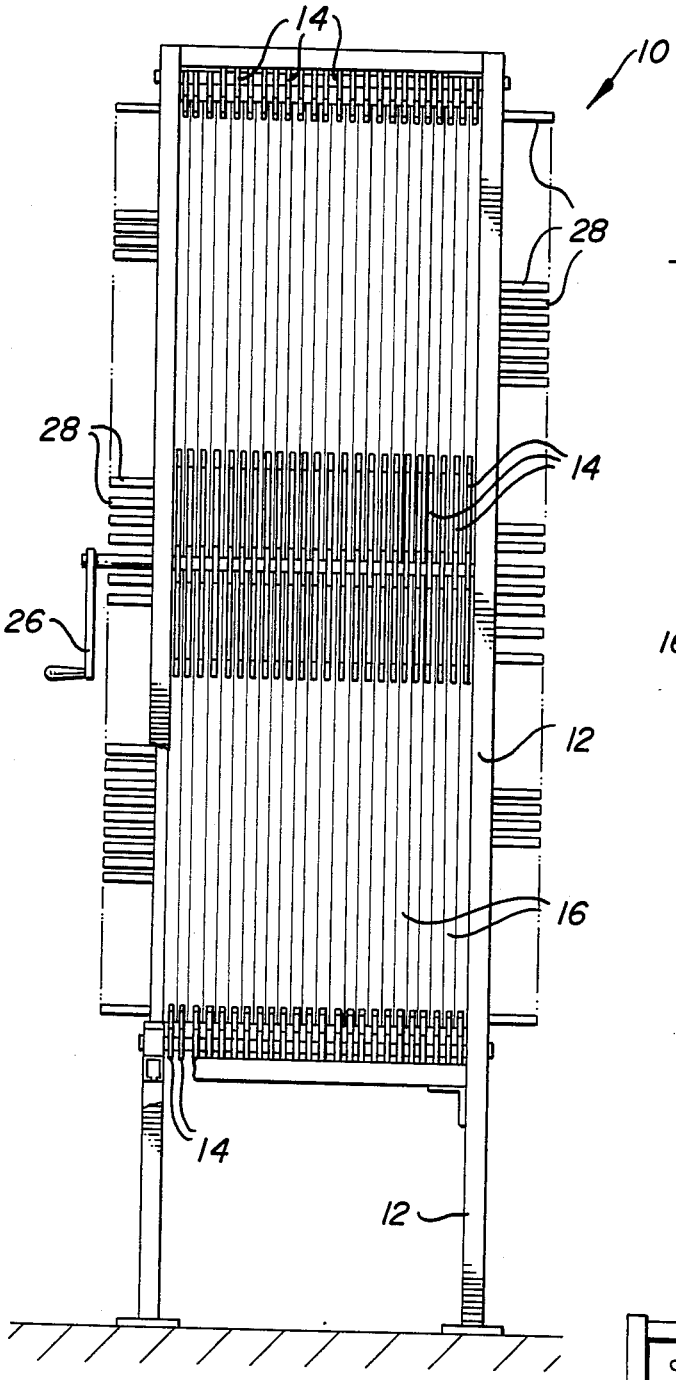
FIG. 2 is a side elevational view of the braiding apparatus shown in FIG. 1.

FIGS. 1 and 2 illustrate one embodiment of the braiding apparatus 10 of the present invention which generally comprises a support frame 12 of any suitable construction and curved stabilizer or support members 14 secured to the support frame and spaced approximately 90° apart for the purpose of rotatably supporting a plurality of ring members 16 of substantially the same size and diameter that are disposed side-by-side in axially aligned relation for rotation about a common axis A.

Each of the ring members 16 may be provided with a plurality of circumferentially spaced, axially extending tracks or grooves 18 extending therethrough. A plurality of fiber carrier members 20 comprise rollers 22 or the like at one end thereof that are slidably mounted in the tracks 18 on the rings 16. Rotatable fiber spools 24 are connected to the rollers 22 of the fiber carriers 20 and extend generally radially inwardly from the ring members 16 so that fiber F can be fed inwardly from the spools 24 to form the article to be braided (not shown).

Figure 4:
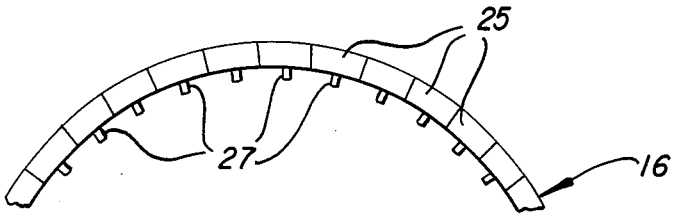
FIG. 4 is a front elevational view of a portion of a modified braiding apparatus wherein the ring members are formed of discrete elements.
Figure 5:
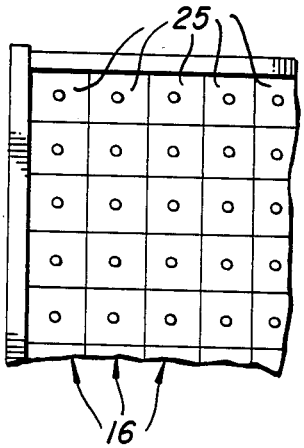
FIG. 5 is a side elevational view of the braiding apparatus shown in FIG. 4.

Within the scope of the present invention, the ring members 16 may be formed of discrete elements 25 (FIGS. 4 and 5) that are axially movable in any suitable manner and support eyelets or spools 27 for the fiber to be braided. This modified construction would replace the axially extending tracks 18 in the ring members and is disclosed in FIG. 1 of the Bluck patent with respect to a generally rectangular braiding apparatus.

In the operation of the braiding apparatus 10 of the present invention, the fibers F being fed inwardly from the spools 24 are intertwined to form the braided article (not shown) by rotating the ring members 16 relative to each other and by moving the rows of fiber carriers axially in a predetermined manner, depending on the braiding pattern desired. The ring members 16 may be rotated about the axis A by any suitable type of manually or power driven actuator 26 which is connected to the rings in any suitable manner, such as through a suitable gearing arrangement (not shown).

The rows of fiber carrier members 20 may be moved axially through the tracks qr grooves 18 in the ring members 16, or by the discrete elements 25 of the ring members 16, by any suitable actuating means, such as slidable rods or pistons 28 that are disposed at opposite ends of the fiber carrier member rows for slidably moving the rows axially in a predetermined manner relative to each other. The actuators 28 may be driven by any suitable means (not shown), such as by mechanical or pneumatic drive means.

As taught in the Bluck and Florentine patents, empty spaces (not shown) are provided at the ends of the fiber carrier member rows to accommodate the shifting of the rows. As an illustrative example, these empty spaces could be provided in the ring members at the ends of the present braiding apparatus and the end ring members would not be rotatable.

Figure 3:
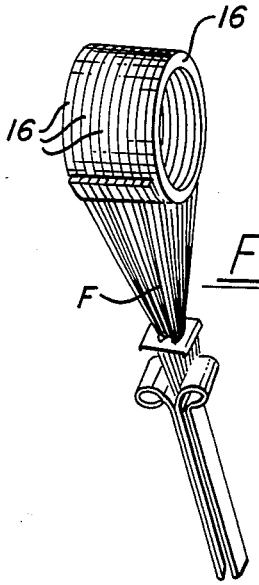
FIG. 3 is a perspective view of a second embodiment of the braiding apparatus of the present invention.

As an illustrative example, the actuating drive means 26 may be constructed to rotate adjacent ring members 16 in opposite directions through a predetermined distance, and the actuating means 28 may be constructed to move adjacent rows of carrier members 20 in opposite axial directions through a predetermined distance to intertwine the fibers F extending inwardly from the spools 24. Examples of such braiding patterns are shown in FIG. 3 of the Bluck patent and in FIGS. 5 and 9 of the Florentine patent. Within the scope of the present invention, the spools 24 could extend outwardly from the ring members 16 so as to intertwine the fibers F toward one or both sides of the braiding apparatus, as shown in FIG. 3.

The cylindrical apparatus of the present invention is particularly advantageous in that all of the ring members 16 are of substantially the same size and construction so as to be readily interchangeable and expandable. Also, the braiding apparatus 10 of the present invention requires far less space than the conventional, flat circular braiding apparatus and is capable of braiding axisymmetric and cartesian structures.

What is claimed:

1. Apparatus for braiding an article from a plurality of fibers, comprising:

a plurality of ring members of substantially the same size, said ring members being disposed side-by-side in axially aligned relation and having means for supporting fiber carriers for axial movement relative thereto;

means for supporting said ring members for rotation about a common central axis relative to each other;

a plurality of rows of fiber carriers mounted on said ring members for axial movement relative to said ring members; and actuating means to rotate said ring members and to move said rows of fiber carriers axially in a predetermined manner to intertwine the fibers.

2. The apparatus of claim 1 wherein said means for supporting fiber carriers are circumferentially spaced, axially extending tracks in said ring members; and said fiber carriers are slidably mounted in said tracks.

3. The apparatus of claim 1 wherein said means for supporting fiber carriers are axially movable discrete elements of said ring members; and said fiber carriers are mounted on said discrete elements.

4. The apparatus of claim 1 wherein said actuating means are constructed to rotate adjacent ring members in opposite directions and to move adjacent rows of fiber carriers in opposite axial directions.

5. The apparatus of claim 1 wherein the fibers are fed from the carriers to the interior space defined by the ring members.

6. The apparatus of claim 1 wherein the fibers are fed from the carriers to the exterior of the ring members.

* * * * *